US008529277B2

(12) United States Patent
Williams et al.

(10) Patent No.: US 8,529,277 B2
(45) Date of Patent: Sep. 10, 2013

(54) FLEX TO FLEX CONNECTION DEVICE

(75) Inventors: Willis Williams, Fontana, CA (US); Derick Esquivel, Pomona, CA (US)

(73) Assignee: Hi Rel Connectors, Inc, Claremont, CA (US)

( * ) Notice: Subject to any disclaimer, the term of this patent is extended or adjusted under 35 U.S.C. 154(b) by 0 days.

(21) Appl. No.: 13/398,624

(22) Filed: Feb. 16, 2012

(65) Prior Publication Data

US 2012/0315774 A1 Dec. 13, 2012

Related U.S. Application Data

(60) Provisional application No. 61/444,681, filed on Feb. 18, 2011, provisional application No. 61/450,076, filed on Mar. 7, 2011.

(51) Int. Cl.
*H01R 12/00* (2006.01)

(52) U.S. Cl.
USPC ..... 439/75; 439/369; 439/498; 439/655

(58) Field of Classification Search
USPC ..... 439/67, 74, 75, 492, 493, 494, 495, 439/498, 329, 499, 369, 638, 650–655
See application file for complete search history.

(56) References Cited

U.S. PATENT DOCUMENTS

| | | | | |
|---|---|---|---|---|
| 3,189,863 | A * | 6/1965 | Leach | 439/418 |
| 3,613,049 | A * | 10/1971 | Niedzwiecki | 439/329 |
| 3,701,964 | A * | 10/1972 | Cronin | 439/45 |
| 3,721,940 | A * | 3/1973 | Michel et al. | 439/495 |
| 3,796,986 | A * | 3/1974 | Tamburro | 439/329 |
| 3,945,703 | A | 3/1976 | McCormick | |
| 4,012,093 | A * | 3/1977 | Crane | 439/67 |
| 4,125,310 | A * | 11/1978 | Reardon et al. | 439/329 |
| 4,184,729 | A * | 1/1980 | Parks et al. | 439/66 |
| 4,453,795 | A * | 6/1984 | Moulin | 439/361 |
| 4,526,432 | A * | 7/1985 | Cronin et al. | 439/320 |

(Continued)

FOREIGN PATENT DOCUMENTS

| | | |
|---|---|---|
| EP | 0440305 A1 | 8/1991 |
| GB | 2463867 | 3/2010 |

OTHER PUBLICATIONS

International Search Report dated Nov. 23, 2012 for PCT/US2012/029952 (9 pages).

(Continued)

*Primary Examiner* — Ross Gushi

(74) *Attorney, Agent, or Firm* — Cotman IP Law Group, PLC

(57) ABSTRACT

A mechanical device for electrically connecting a first flexible assembly to a second flexible assembly comprises a wafer and a housing. The wafer has an insulator core and a plurality of wafer electrical connectors. The core has a first base side and an opposed second base side. The wafer electrical connectors include a first set of wafer electrical connector contacts exposed on the first base side and a second set of wafer electrical connector contacts exposed on the second base side. The wafer electrical connector contacts are adapted to electrically connect with each of the flexible assembly electrical contacts. The housing retains the wafer, the first flexible assembly terminal, and the second flexible assembly terminal in such a way that each of the first flexible assembly electrical contacts is removably secured and electrically connected to one of the wafer electrical connector contacts.

7 Claims, 4 Drawing Sheets

(56) References Cited

U.S. PATENT DOCUMENTS

| | | | | | |
|---|---|---|---|---|---|
| 4,538,865 | A | * | 9/1985 | Wakabayashi et al. | 439/66 |
| 4,647,125 | A | * | 3/1987 | Landi et al. | 439/67 |
| 4,655,524 | A | | 4/1987 | Etzel | |
| 4,808,112 | A | * | 2/1989 | Wood et al. | 439/66 |
| 4,828,512 | A | * | 5/1989 | McCormick et al. | 439/495 |
| RE33,170 | E | * | 2/1990 | Byers | 607/57 |
| 4,913,656 | A | * | 4/1990 | Gordon et al. | 439/67 |
| 4,975,068 | A | * | 12/1990 | Squires | 439/67 |
| 5,071,357 | A | * | 12/1991 | Van Brunt et al. | 439/67 |
| 5,160,269 | A | * | 11/1992 | Fox et al. | 439/67 |
| 5,219,293 | A | * | 6/1993 | Imamura | 439/67 |
| 5,356,308 | A | * | 10/1994 | Toba et al. | 439/495 |
| 5,372,512 | A | | 12/1994 | Wilson et al. | |
| 5,482,473 | A | * | 1/1996 | Lord et al. | 439/67 |
| 5,484,294 | A | | 1/1996 | Sobhani | |
| 5,484,295 | A | * | 1/1996 | Mowry et al. | 439/66 |
| 5,501,610 | A | * | 3/1996 | Ikemoto | 439/498 |
| 5,632,638 | A | * | 5/1997 | Matsushita et al. | 439/260 |
| 5,782,645 | A | * | 7/1998 | Stobie et al. | 439/289 |
| 5,924,875 | A | * | 7/1999 | Tighe et al. | 439/74 |
| 5,947,750 | A | * | 9/1999 | Alcoe et al. | 439/67 |
| 5,993,247 | A | * | 11/1999 | Kidd | 439/495 |
| 6,017,222 | A | * | 1/2000 | Kao | 439/67 |
| 6,017,244 | A | * | 1/2000 | Daane | 439/495 |
| 6,027,345 | A | * | 2/2000 | McHugh et al. | 439/66 |
| 6,045,396 | A | * | 4/2000 | Tighe | 439/493 |
| 6,064,003 | A | | 5/2000 | Moore et al. | |
| 6,077,090 | A | * | 6/2000 | Campbell et al. | 439/67 |
| 6,165,009 | A | * | 12/2000 | Anbo et al. | 439/498 |
| 6,193,544 | B1 | | 2/2001 | McGinnis | |
| 6,220,881 | B1 | * | 4/2001 | Murakami et al. | 439/262 |
| 6,226,862 | B1 | * | 5/2001 | Neuman | 29/830 |
| 6,230,397 | B1 | * | 5/2001 | Tighe | 29/830 |
| 6,247,951 | B1 | * | 6/2001 | Di Liello et al. | 439/329 |
| 6,250,966 | B1 | * | 6/2001 | Hashimoto et al. | 439/631 |
| 6,299,469 | B1 | * | 10/2001 | Glovatsky et al. | 439/329 |
| 6,383,004 | B1 | * | 5/2002 | Gunay et al. | 439/329 |
| 6,425,768 | B1 | * | 7/2002 | Taylor | 439/67 |
| 6,431,876 | B1 | * | 8/2002 | Svenkeson et al. | 439/67 |
| 6,468,106 | B2 | * | 10/2002 | Durocher | 439/493 |
| 6,520,779 | B1 | * | 2/2003 | Watanabe et al. | 439/66 |
| 6,721,189 | B1 | | 4/2004 | Haba | |
| 6,722,915 | B1 | * | 4/2004 | McAlonis et al. | 439/498 |
| 6,753,477 | B1 | * | 6/2004 | Sinkunas et al. | 174/117 FF |
| 6,817,870 | B1 | * | 11/2004 | Kwong et al. | 439/74 |
| 6,896,552 | B2 | | 5/2005 | Kosmala | |
| 7,033,208 | B1 | * | 4/2006 | Huang et al. | 439/498 |
| 7,131,861 | B2 | * | 11/2006 | Aeschbacher | 439/495 |
| 7,223,105 | B2 | * | 5/2007 | Weiss et al. | 439/66 |
| 7,341,476 | B2 | * | 3/2008 | Soeta | 439/493 |
| 7,462,035 | B2 | * | 12/2008 | Lee et al. | 439/37 |
| 7,731,517 | B2 | * | 6/2010 | Lee et al. | 439/271 |
| 7,878,859 | B2 | * | 2/2011 | Zhu | 439/638 |
| 7,980,863 | B1 | | 7/2011 | Holec et al. | |
| 8,007,286 | B1 | | 8/2011 | Holec et al. | |
| 8,251,712 | B2 | * | 8/2012 | Cheng | 439/67 |
| 2003/0232524 | A1 | | 12/2003 | Burdick | |
| 2005/0266725 | A1 | * | 12/2005 | Pabst | 439/494 |
| 2007/0184682 | A1 | * | 8/2007 | Gobron | 439/67 |
| 2009/0149036 | A1 | * | 6/2009 | Lee et al. | 439/37 |
| 2009/0149037 | A1 | * | 6/2009 | Lee et al. | 439/37 |
| 2012/0315773 | A1 | * | 12/2012 | Esquivel et al. | 439/67 |
| 2012/0315774 | A1 | * | 12/2012 | Williams et al. | 439/68 |

OTHER PUBLICATIONS

International Search Report dated Nov. 28, 2012 for PCT/US2012/029957 (11 pages).

* cited by examiner

FLEX TO FLEX CONNECTION DEVICE

CROSS-REFERENCE TO RELATED APPLICATIONS

This application claims priority from Provisional Patent Application Ser. No. 61/444,681, filed Feb. 18, 2011, entitled FLEX TO FLEX TERMINATION SYSTEM, which is incorporated in its entirety herein, as well as from Provisional Patent Application Ser. No. 61/450,076, filed Mar. 7, 2011, entitled CONNECTOR TO FLEX DEVICE, which is also incorporated in its entirety herein.

FIELD OF THE INVENTION

The invention relates generally to electrical connection assemblies and, more particularly, to connection assemblies comprising a pair of flexible electrical conductors.

BACKGROUND OF THE INVENTION

Sophisticated electrical and electronic components are frequently disposed proximate to high vibration equipment, such as aircraft and rocket engines. Because of the narrow confines wherein such components are typically disposed, interconnecting such components often employs the use of flexible electrical conductors ("flexible assemblies").

The prior art methods of attaching a flexible assembly to another flexible assembly usually employ some form of permanent attachment, such as methods wherein the flexible assemblies are soldered to one another.

Problems arise in such prior art methods when the attachment between the two flexible assemblies fails. Such failures cannot easily (if at all) be repaired in the field, and, in most cases, require the complete replacement of both flexible assemblies. Such complete replacement of both assemblies can be awkward, time-consuming and expensive.

Accordingly, there is a need for a method of attaching a flexible assembly to another flexible assembly which does not involve the aforementioned problems in the prior art.

SUMMARY OF THE INVENTION

The invention satisfies this need. The invention is a mechanical device for electrically connecting a first flexible assembly to a second flexible assembly, wherein the first flexible assembly comprises a first flexible assembly terminal end having a plurality of first flexible assembly electrical contacts and the second flexible assembly comprises a second flexible assembly terminal end having a plurality of second flexible assembly electrical contacts, the invention comprising (a) a wafer comprising an insulator core and a plurality of wafer electrical connectors, the core having a first base side and an opposed second base side, the wafer electrical connectors comprising a first set of wafer electrical connector contacts exposed on the first base side and a second set of wafer electrical connector contacts exposed on the second base side, each electrical contact in the first set of wafer electrical connector contacts being electrically connected to a corresponding electrical contact in the second set of wafer electrical connector contacts, each wafer electrical connector contact being sized and dimensioned to electrically connect with a first flexible assembly electrical contact or a second flexible assembly electrical contact, and (b) a housing for accepting and retaining (i) the wafer, (ii) the first flexible assembly terminal end disposed adjacent to the first base side of the wafer, and (iii) the second flexible assembly terminal end disposed adjacent to the second base side of the wafer, such that each of the first flexible assembly electrical contacts is removably secured and electrically connected to the first set of wafer electrical connector contacts and each of the second flexible assembly electrical contacts is removably secured and electrically connected to the second set of wafer electrical connector contacts.

DRAWINGS

DETAILED DESCRIPTION OF THE INVENTION

Figure 1:
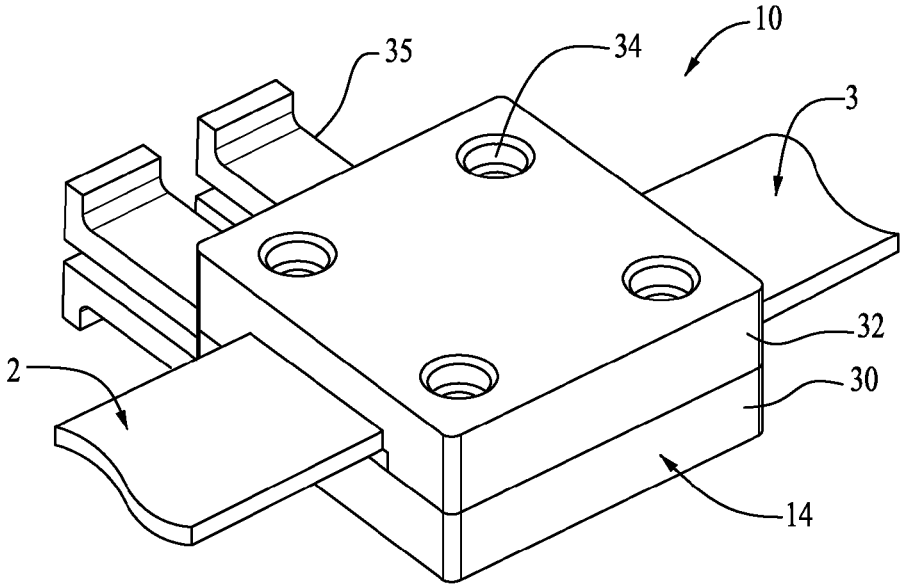
FIG. 1 is a perspective view of a mechanical device of the invention.
Figure 5:
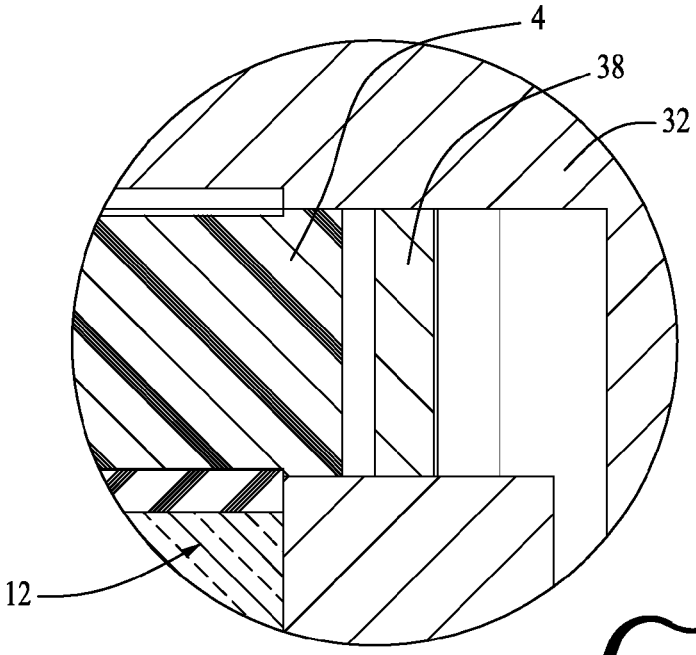
FIG. 5 is a detail view of a portion of the mechanical device illustrated in FIG. 4.
Figure 2:
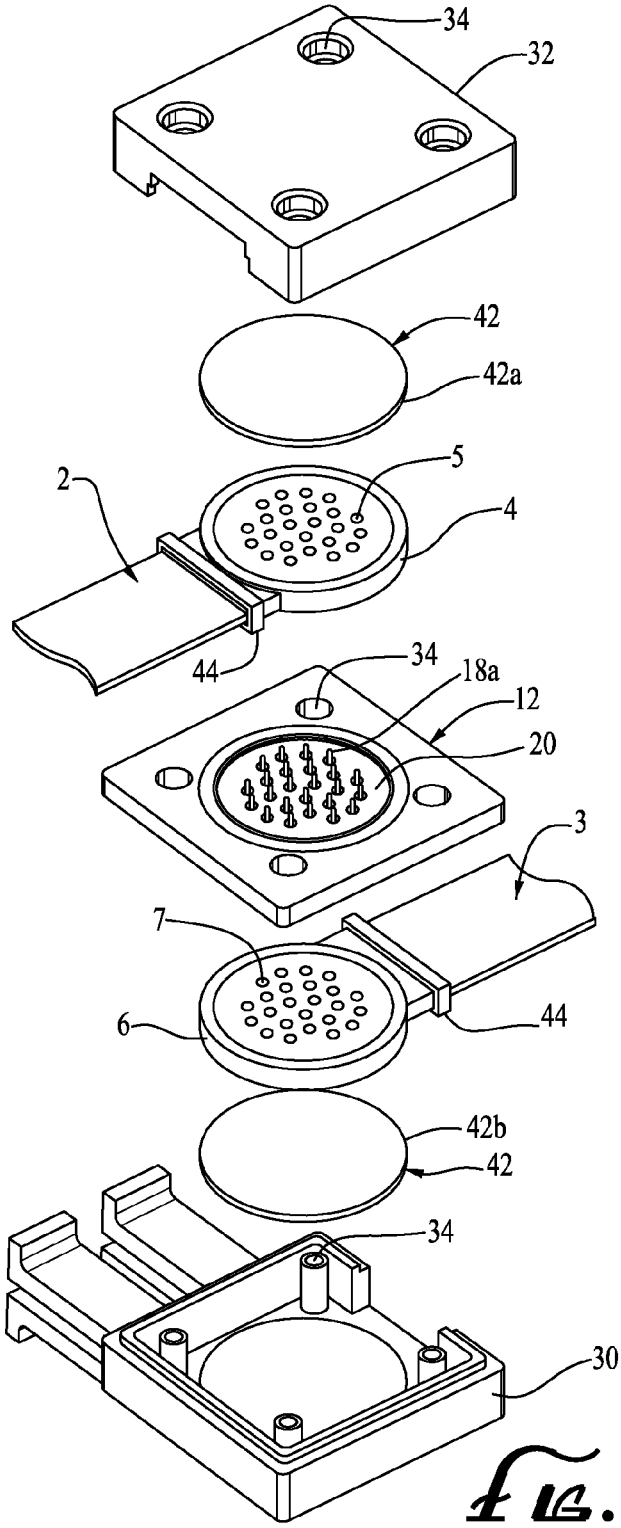
FIG. 2 is an exploded view of the mechanical device illustrated in FIG. 1.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a mechanical device 10 for electrically connecting a first flexible assembly 2 to a second flexible assembly 3. The first flexible assembly comprises a first flexible assembly terminal end 4 having a plurality of first flexible assembly electrical contacts 5, and the second flexible assembly comprises a second flexible assembly terminal end 6 having a plurality of second flexible assembly electrical contacts 7. The invention comprises a wafer 12 and a housing 14.

The wafer 12 is responsible for passing electrical signals and/or power distribution from one flexible assembly to the other.

The wafer 12 comprises an insulator core 16 and a plurality of wafer electrical connector contacts 18. The insulator core 16 can be a hermetic glass insulator 36.

The wafer electrical connector contacts 18 comprise a first set of wafer electrical connector contacts 18*a* exposed on a first base side 20 of the wafer 12 and a second set of wafer electrical connector contacts 18*b* exposed on a second base side 22 of the wafer 12. Each electrical contact 18 in the first set of wafer electrical connector contacts 18*a* is electrically connected to a corresponding electrical contact 18 in the second set of wafer electrical connector contacts 18*b*. Each wafer electrical contact 18 is sized and dimensioned to electrically connect with a first flexible assembly electrical contact 5 or a second flexible assembly electrical contact 7.

The contacts 5, 7 and 18 are reversible, in that they are readily replaceable and can be readily disengaged and reengaged without tools. The contacts 5, 7 and 18 are typically either double-ended pins 24 or double-ended sockets 26. The wafer 12 can have pin and/or socket electrical connector contacts of varying sizes.

The wafer electrical connector contacts 18 are typically spaced apart across the wafer 12. The wafer 12 can have dissimilar contact patterns on opposed sides of the wafer 12. The wafer 12 can be configured in various contact densities and patterns.

The wafer 12 can also comprise EMI/EMC bonding mechanisms and can include environment sealing features.

The wafer 12 can be constructed to be an active device, such as a device capable of acting as a transducer, DioD, capacitor or other electronic component, by attaching or embedding circuitry and/or electrical components therein.

The wafer 12 can be manufactured from various materials and can employ various dielectric materials.

The housing 14 is sized and dimensioned to accept and retain the wafer 12, the first flexible assembly 2 and the second flexible assembly 3. The first flexible assembly terminal end 4 is disposed adjacent to the first base side 20 of the wafer 14 and the second flexible assembly terminal end 6 is disposed adjacent to the second base side 22 of the wafer 14, such that each of the first flexible assembly electrical contacts 5 is removably secured and electrically connected to the first set of wafer electrical contacts 18*a* and each of the second flexible assembly electrical contacts 7 is removably secured and electrically connected to the second set of wafer electrical contacts 18*b*.

The housing 14 incorporates multiple entry and exit locations 28 for the flexible assemblies 2 and 3.

The housing 14 is typically stackable and comprises a base 30 and a top cover 32. The top cover 32 is secured to the base 30 by reversible fasteners. In the embodiment illustrated in the drawings, bores 34 are provided at each corner of the housing 14 to facilitate securing of the top cover 32 and the base 30 by bolts. Alternatively, the top cover 32 and the base 30 can be secured by nut and bolt pairs, clips, clamps or other equivalent reversible fasteners. Typically, the base 30 and the top cover 32 are made of interlocking construction for EMI and fire protection.

In the embodiment illustrated in the drawings, the housing 14 further comprises installation brackets 35.

The housing 14 can be made from a multitude of materials, including, but not limited to, aluminum, titanium, steel, plastic, PEEK and many different composite materials.

The housing 14 can be adapted to accommodate flexible assemblies having any shaped terminal end.

The housing 14 can also serve as an enclosure for various additional accessories, such as a mounting device.

The device 10 of the invention also typically comprises a double-ended grounding pad 38 and an interfacial seal 40.

The device 10 of the invention can also comprise gaskets 42 and/or grommets 44 to serve an array of functions, such as environmental sealing, EMI bonding, EMC bonding, vibration dampening and air volume reduction. The gaskets 42 can serve as a first spacer 42*a* and a second spacer 42*b*. The first spacer 42*a* is disposed between the housing 14 and the first flexible assembly 2 and the second spacer 42*b* is disposed between the housing 14 and the second flexible assembly 3.

Figure 3:
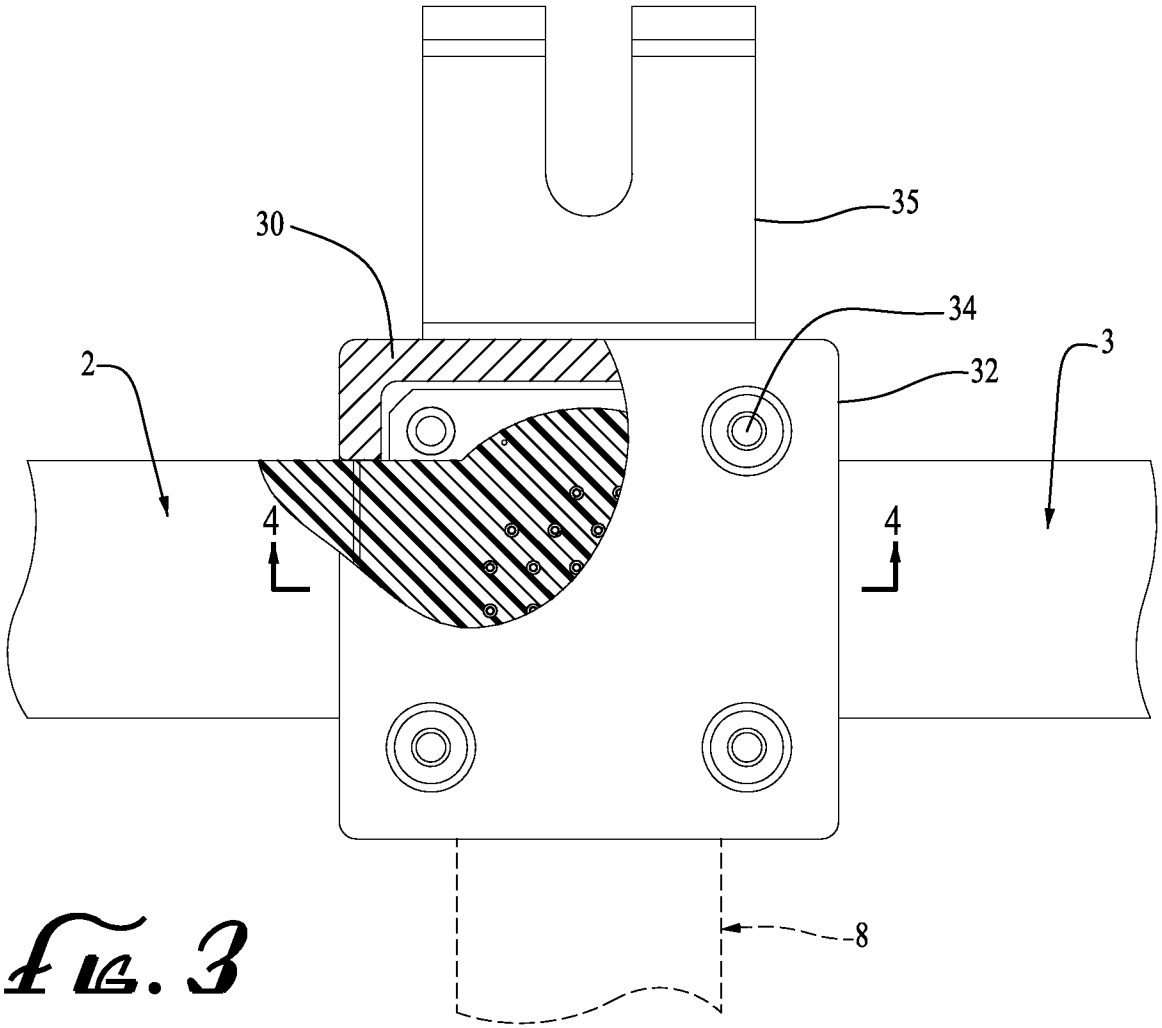
FIG. 3 is a top view in partial cross-section of the mechanical device illustrated in FIG. 1.
Figure 4:
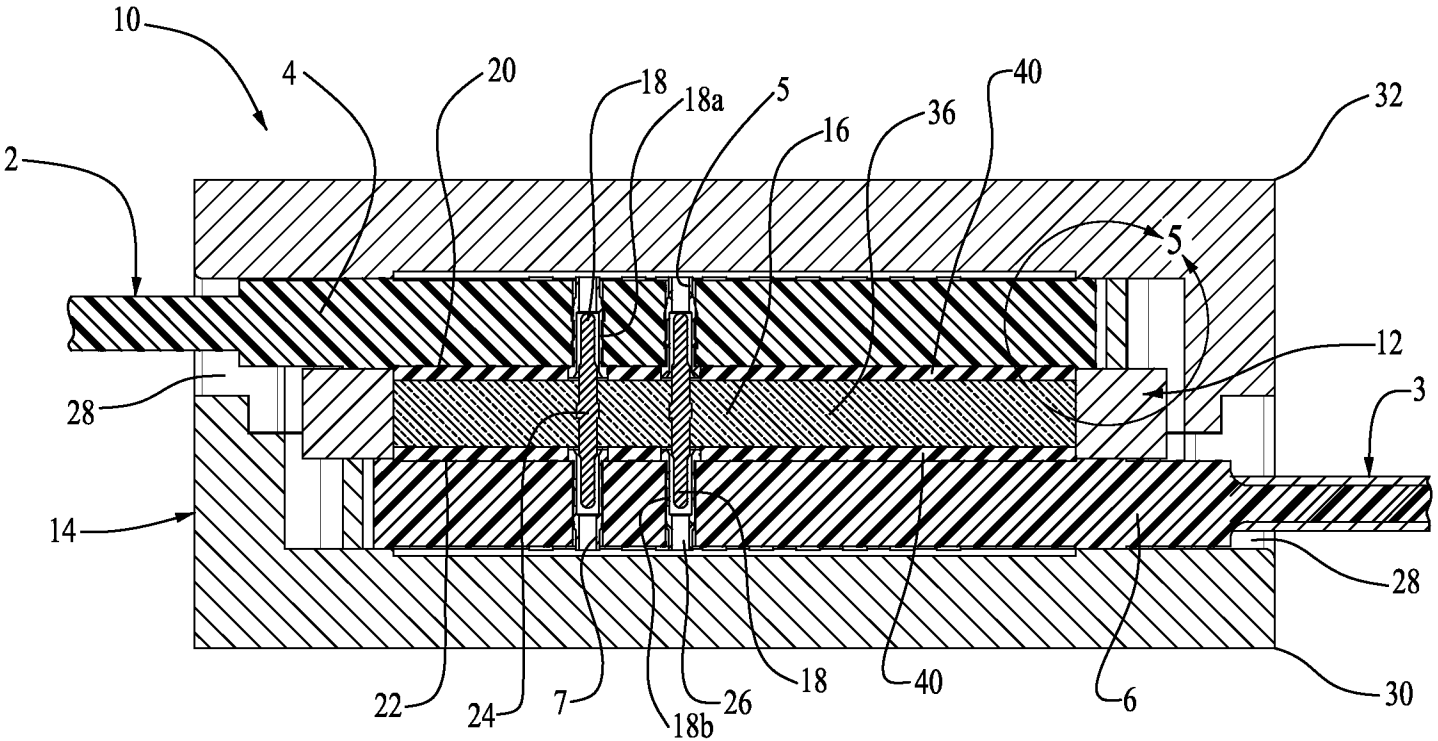
FIG. 4 is a cross-sectional side view of the mechanical device illustrated in FIG. 1.

It should be noted that the device can be adapted to electrically connect more than two flexible assemblies. For example, FIG. 3 illustrates the electrical connection of a first flexible assembly 2, a second flexible assembly 3 and a third flexible assembly 8.

The device 10 of the invention employs no solder or other permanent, non-reversible connections with the terminal ends of the flexible assemblies 2 and 3.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A mechanical device for electrically connecting a first flexible assembly to a second flexible assembly, wherein the first flexible assembly comprises a first flexible assembly terminal end having a plurality of first flexible assembly electrical contacts and the second flexible assembly comprises a second flexible assembly terminal end having a plurality of second flexible assembly electrical contacts, the invention comprising:

(a) a wafer comprising an insulator core and a plurality of wafer electrical connectors, the core having a first base side and an opposed second base side, the wafer electrical connectors comprising a first set of wafer electrical connector contacts exposed on the first base side and a second set of wafer electrical connector contacts exposed on the second base side, each electrical contact in the first set of wafer electrical connector contacts being electrically connected to a corresponding electrical contact in the second set of wafer electrical connector contacts, each wafer electrical connector contact being sized and dimensioned to electrically connect with a first flexible assembly electrical contact or a second flexible assembly electrical contact;

(b) a housing for accepting and retaining (i) the wafer, (ii) the first flexible assembly terminal end disposed adjacent to the first base side of the wafer, and (iii) the second flexible assembly terminal end disposed adjacent to the second base side of the wafer, such that each of the first flexible assembly electrical contacts is removably secured and electrically connected to the first set of wafer electrical connector contacts and each of the second flexible assembly electrical contacts is removably secured and electrically connected to the second set of wafer electrical connector contacts; and a hermetic glass insulator or other insulator disposed within the wafer between the first and second flexible assemblies, a circumferential double ended grounding pad for surrounding the terminal ends of both flexible assemblies and an interfacial seal.

2. The device of claim 1 wherein the housing further comprises a first spacer and a second spacer, the first spacer being located between the housing and the first flexible assembly, and the second spacer being located between the housing and the second flexible assembly.

3. The device of claim 1 wherein the device further comprises grommets.

4. The device of claim 1 wherein the wafer electrical connectors are pins.

5. The device of claim 4 wherein the pins are spaced equally apart across the wafer.

6. The device of claim 4 wherein the plurality of first flexible assembly electrical contacts and the plurality of second flexible assembly electrical contacts are sized and dimensioned to electrically connect with the pins.

7. The device of claim 1 wherein the housing comprises a top cover and a bottom cover, the top cover being secured to the bottom cover by reversible fasteners.

* * * * *